United States Patent [19]

Nock

[11] Patent Number: 5,015,047

[45] Date of Patent: May 14, 1991

[54] DRAWER SUPPORT ASSEMBLY

[75] Inventor: Hans Nock, Rohrdorf, Fed. Rep. of Germany

[73] Assignee: Hafele KG, Nagold, Fed. Rep. of Germany

[21] Appl. No.: 456,332

[22] Filed: Dec. 26, 1989

[30] Foreign Application Priority Data

Dec. 31, 1988 [DE] Fed. Rep. of Germany ..... 8816223

[51] Int. Cl.[5] ..... A47B 88/00

[52] U.S. Cl. ..... 312/335; 312/341.1; 312/234.5

[58] Field of Search ..... 312/330.1, 341.1, 335, 312/234.5, 234.4, 234.3, 234.2, 234.1, 348.4

[56] References Cited

U.S. PATENT DOCUMENTS

| | | | |
|---|---|---|---|
| 1,844,845 | 2/1932 | Eustis | 312/335 |
| 3,053,582 | 9/1962 | Wenger | 312/341.1 X |
| 3,756,652 | 9/1973 | Trammell | 312/330.1 |
| 3,942,852 | 3/1926 | Anthony | 312/234.3 X |
| 4,473,262 | 9/1984 | Staye | 312/330 X |
| 4,624,509 | 11/1986 | Ramsey | 312/234.5 |
| 4,653,818 | 3/1987 | DeBruyn | 312/335 X |
| 4,902,080 | 2/1990 | Berger | 312/234.3 X |

*Primary Examiner*—Joseph Falk

*Attorney, Agent, or Firm*—Toren, McGeady & Associates

[57] ABSTRACT

A support assembly for a drawer permits the drawer to be located in different positions. The drawer has a pair of laterally spaced side pieces supported on telescopically slidable guide rails. The guide rails have brackets selectively engageable in openings formed in sections attached to the side pieces for obtaining the different positions of the drawer.

13 Claims, 5 Drawing Sheets

DRAWER SUPPORT ASSEMBLY

BACKGROUND OF THE INVENTION

The present invention is directed to a drawer, a drawer frame, or the like, detachably fastened on a pair of guide rails.

There are closets, equipped particularly with a plurality of drawers or hanging frames, where the front sides of the drawers or panels, arranged at the front sides of the drawers, close flush with the front of the closet framework. In another arrangement, the closet framework has a special door covering the front side of the drawers or their panels. In such an arrangement, it is necessary that the drawers are inset into the closet framework in the closed position.

SUMMARY OF THE INVENTION

Therefore, it is the primary object of the present invention, taking into account the peculiarities of the different structural forms, mentioned above, to arrange the drawers in a way that their front sides or panels are located approximately flush with the front side of the closet framework, or in a position inset from the front side of the closet framework, leaving sufficient space for a closet door to be closed.

In accordance with the present invention, the drawer is displaceable in its long or sliding direction relative to a supporting pair of rails and can be fixed, as desired, in at least two positions spaced from one another in the sliding direction. The spacing of the two positions is established precisely by the amount the front side of the drawer, or drawer panel, is offset into the closet framework relative to the front side of the framework when the front side of the closet is closed by a door. As a result, the same drawer and support assembly can be used for securing the drawer in two different spaced positions relative to the pair of guide rails.

An effective and secure connection between the drawer and the pair of guide rails can be achieved when the drawer can be secured in two spaced positions with respect to the guide rails.

The connections between the drawer, or drawer frame, and the slide rails can be formed as lockable plug-in connections. Such a plug-in connection can be constructed of at least two brackets, or similar structure, arranged at a distance from one another on a rail of the guide rails with the brackets projecting upwardly. One of the brackets has two cut-out portions. These cut-out portions fit into corresponding side pieces of the drawer at a distance a from one another, and penetrated by the bracket. The other bracket extends through a longitudinal slot cut into the side piece of the drawer, with the slot having a length of a+b, wherein b signifies the length of the bracket foot and both of the slot ends serve alternately as abutments for the front edge and rear edge of the other bracket depending on the particular position of the drawer. Using this particular plug-in connection, initially the drawer is lowered onto rails of the guide rails from above, whereby the brackets located on the rails extend from below through cut-out portions formed in the side pieces of the drawer or its frame. If the front side of the drawer, or its panel, closes flush with the front side of the closet framework, the front brackets, located at the rails, engage the rear of two cut-out portions located in the drawer at a distance a from one another, whereby the drawer is supported at the rear edges of the two rear brackets by the rear edges of the longitudinal slots formed in it.

To form a secure connection between the drawer and the two guide rails, it is advantageous to provide a cut-out portion for the engagement of a catch or the like acted on by a spring, located in one of the brackets on the guide rail. Advantageously, such a catch comprises two catch pins, or the like, arranged at a distance a from one another and engaging alternately in a cut-out portion of the respective bracket. The catch pins can be provided on a spring clip or the like supported at both of its ends o the drawer.

Further, it is advantageous if the inner guide rail of the two telescopically arranged guide rails, has a U-shaped section extending along a part of its height. In contrast, the outer guide rail is covered relative to the closet framework by an apron, or the like, which has an S-shaped section. A locking cam, allowing only one drawer to be pulled out at a time, fixes the remaining drawers in their closed- or pushed-in position in a known manner. This locking cam can be arranged on the outer apron.

Moreover, if the drawer is equipped on its front side with an easily detachable drawer panel, it is preferred that a corresponding plug-in connection secure the panel in place. A shaped part, forming a drawer corner and connected with a drawer part, particularly with the drawer panel, for instance, by means of spring clips, or the like, can be arranged at each of the drawer panels at both ends.

Finally, it is conceivable that a roller, roll, or the like, located in the region of one front drawer corner, particularly at the front drawer panel, with the roller, or roll, or the like, rolling at the inside of a closet door when the drawer is pulled out allowing the drawer to be pulled out when the closet door is not completely swivelled out into its open position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
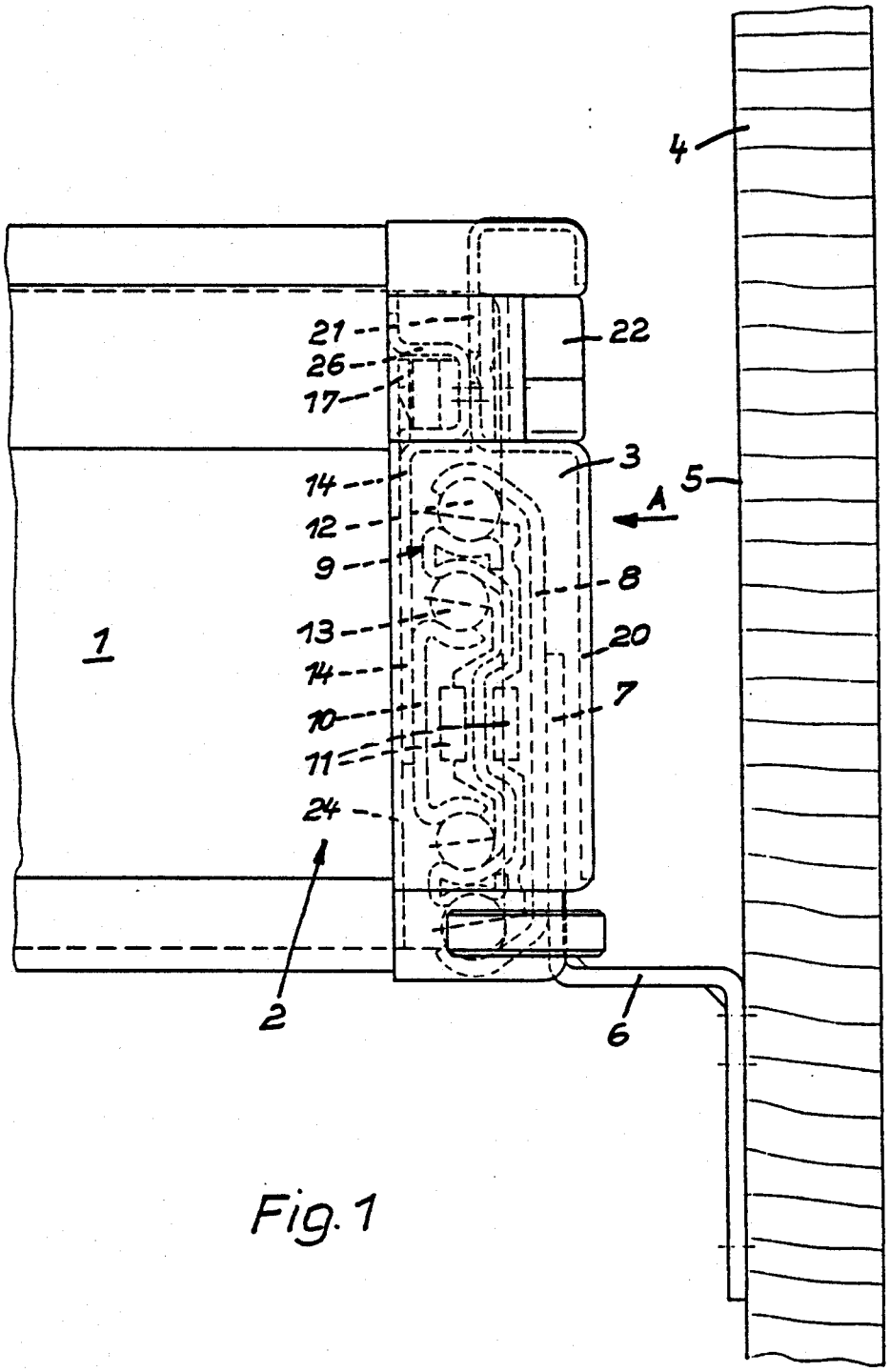
FIG. 1 is a partial front view of a drawer.

FIG. 1 displays a front view of a right-hand portion of a drawer 1, having a frame 2, with a corner piece 3, attached to the frame. Drawer 1 is located in a drawer closet, not shown in detail, however, the right-hand side wall 4 of the closet framework is illustrated. A Z-shaped angle 6 is secured to the inside 5 of closet wall 4, and it has an upwardly extending leg 7, located inwardly from the wall 4, and serving as a support for a stationery outer rail 8 of a telescopically arranged guide rail 9. Inner rail 10 engages telescopically in the stationery outer rail 8 of the guide rail 9, and a ball-bearing cage 11 with balls 12 and 13 is supported between the inner rail 1 and the outer rail 8. As displayed in FIGS. 3 and 4, two carrying plates 14, 15, partially bent outwardly, are located on the inner rail 10. Carrying plate 14, located adjacent to a drawer crosspiece 16 at the front side of the drawer, includes an upwardly extending bracket 17 and the carrying plate 15 closer to the back 18 of the drawer has an upwardly extending catch hook 19.

As can be seen in FIG. 1, outer rail 8 is covered by an apron 20 which has an S-shape in cross-section and terminates at the top in a C-shaped section 21. Section 21 serves to receive a connecting link 22, having grooves 23, serving to receive and guide the pin of a locking device, not shown in detail, for insuring that not more than one drawer can be pulled out of the drawer closet at a time.

The frame 2 of drawer 1 has two side pieces 24 extending in parallel and laterally spaced from one another, with the side pieces extending in the direction of the adjacent guide rails 9. A crosspiece 16 is located at the front side of the drawer frame, and another cross piece 25 is located at the rear side of the frame. The two side pieces 24 terminate in the upward direction in a C-shaped section 26 open toward the interior of the drawer, note FIGS. 5 and 6. As can be seen best in FIGS. 3, 4, 5, and 6 slot-shaped openings 27, 28, 29 are cut in the C-shaped section 26.

In the initial placement of the drawer frame 2, it is suspended between two laterally spaced inner rails 10 of the guide rails 9, note FIGS. 3 and 4, and the frame is introduced into the guide rails in the following manner: the rear cross-piece 25 of the drawer frame is first lowered toward the two carrying plates 15 located at the two inner rails 10 until the catch hooks 19 formed on the carrying plates 15 project through the longitudinal slots 29 cut in the C-shaped sections 26 of the side pieces 24. Next, the drawer frame is displaced in the direction of the arrow 30, note FIG. 3, until the rear ends 31 of the longitudinal slots 29 abut at the rear ends of the catch hooks 19 and are supported at the hooks. From this position, the front crosspiece 16 of the drawer frame is lowered in the direction of arrow 33, note FIG. 3, toward the two front carrying plates 14 until the brackets 17 on these plates project through the rear openings 28, also located in the C-shaped section 26 of the side pieces 24, as displayed in FIG. 4.

Figures 5, 6, 7, 8, 9:
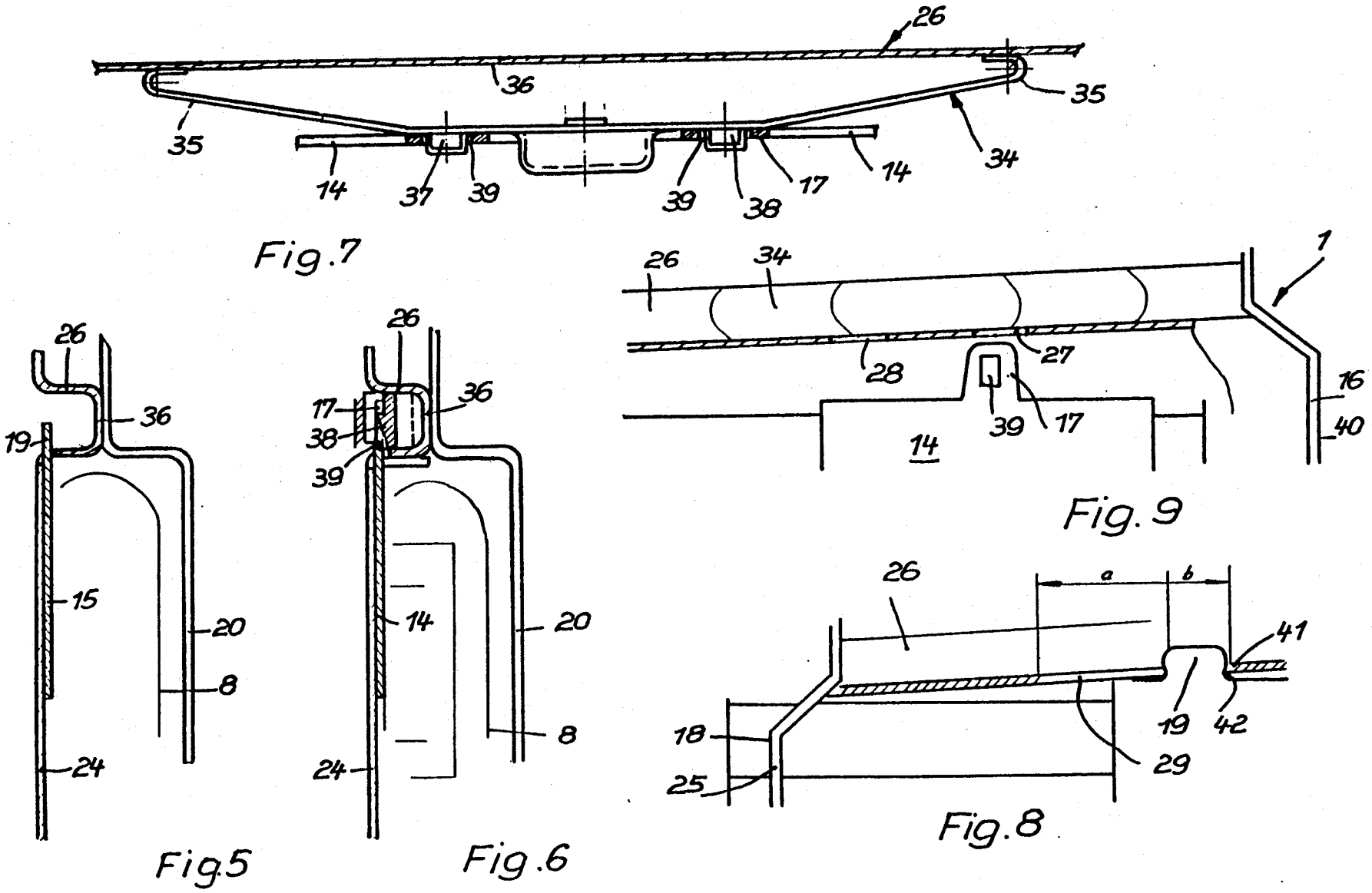
FIG. 5 is a sectional view taken along the line V—V in FIG. 4.
FIG. 6 is a sectional view taken along the line VI—VI in FIG. 4.
FIG. 7 is a top view, partly in section, of a drawer catch.
FIGS. 8 and 9 are partial views, partly in section, similar to FIG. 3, however, with the drawer set in an inwardly recessed position.

To prevent any accidental disengagement and lifting of the drawer frame 2 from the carrying plates 14, 15 on the opposite sides, a spring clip 34 is placed in the C-shaped section 26 of the two side pieces 24. Spring clip 34, note FIG. 7, is supported at the web 36 of the C-shaped section 26 by its opposite ends 35. Two catch pawls 37, 38 are formed on the spring clip at a distance a from one another. Catch pawl 37 engages in a cut-out portion 39 located in bracket 17 in the lowered position of the drawer frame shown in FIG. 4, as is illustrated in FIG. 6. Since the drawer frame 2 is also secured against a longitudinal displacement by the bracket 17, the drawer frame cannot be lifted from the rear carrying plates because of the shape of the two catch hooks 19.

Figure 3:
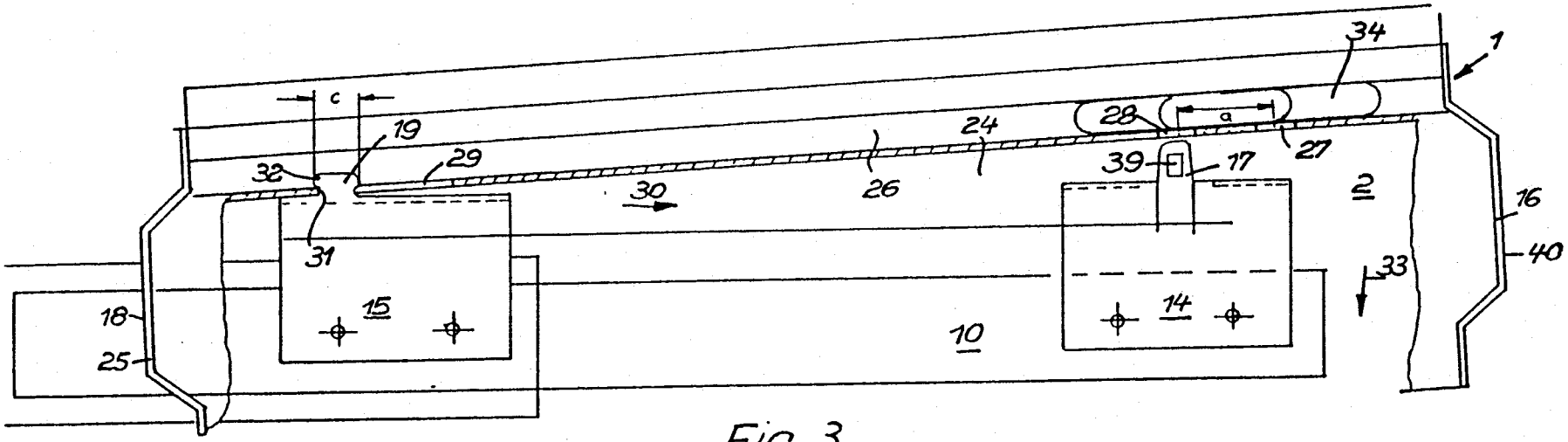
FIG. 3 is a side view of the drawer being placed on the guide rail, but not yet completely lowered into position, and shown in section.
Figure 4:
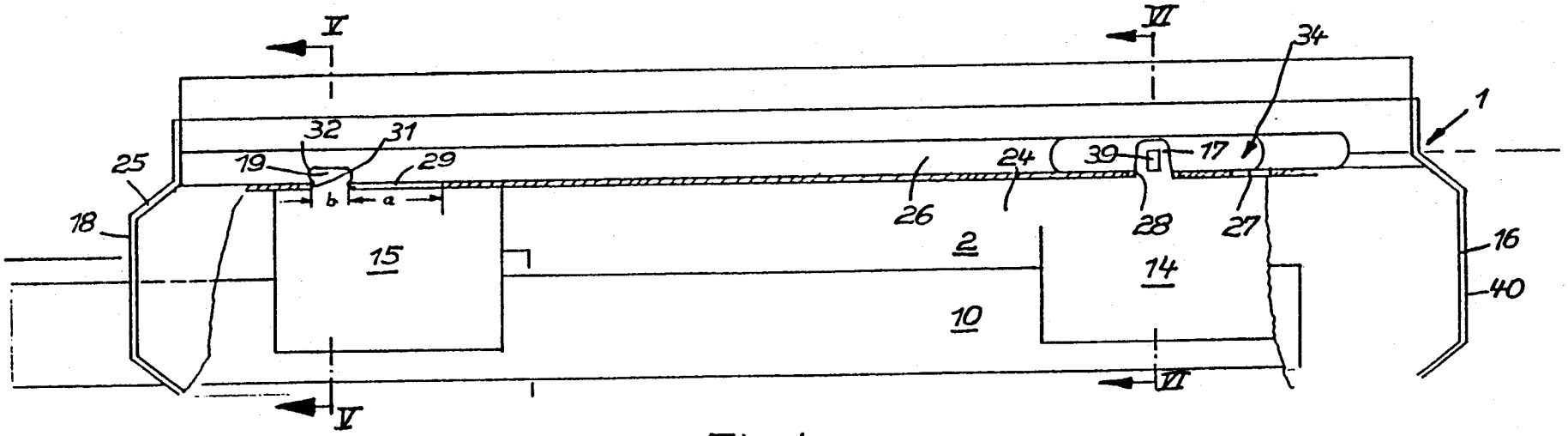
FIG. 4 is a side view, similar to FIG. 3, however, with the drawer completely lowered onto the guide rail.

When suspending the drawer frame 2, as shown in FIGS. 3 and 4, it is drawn in the direction of arrow 30 until the brackets 17 of the two forward carrying plates 14 extend through the rear openings 28 located in the two side pieces 24 and the front side 40 of the front crosspiece 16 closes flush with the front side of the drawer closet framework, not shown.

On the other hand, if the drawer closet has a closet door which folds outwardly, it is necessary that the front side of each drawer frame 2 is set back relative to the front side of the drawer closet. In such an arrangement, when suspending the drawer frame 2, its rear crosspiece 25 is lowered toward the two rear carrying plates in the same manner. As soon as the two catch hooks 19 pass through the longitudinal slots 29, formed in the C-shaped section 26, the drawer frame 2 is pushed opposite to the direction of arrow 30 until the front ends 41 of the two longitudinal slots 29 abut against the front edges 42 of the catch hooks 19, note FIG. 8. Next, the front crosspiece 16 of the drawer frame 2 is lowered toward the two front carrying plates 14 in the direction of the arrow 33 in the same manner, with the bracket 17 extending through the front openings 27 located in the C-shaped section 26. In this arrangement, accidental disengagement and lifting of the drawer frame from the carrying plates is again prevented in the same manner by means of the spring clip 34, however, the front catch projections 38 engage in the cut-out portions 39 located in the brackets 17. Since the front openings 27 and 28, which are located in the C-shaped section 26, and the catch projections 37 and 38 are arranged at the same distance a apart, the front side is inset relative to the previously described position of the drawer frame by the distance a. This distance a causes the longitudinal slots 29 to have a length a+b, where the distance b equals the length of each foot or base of the two catch hooks 19.

Figure 2:
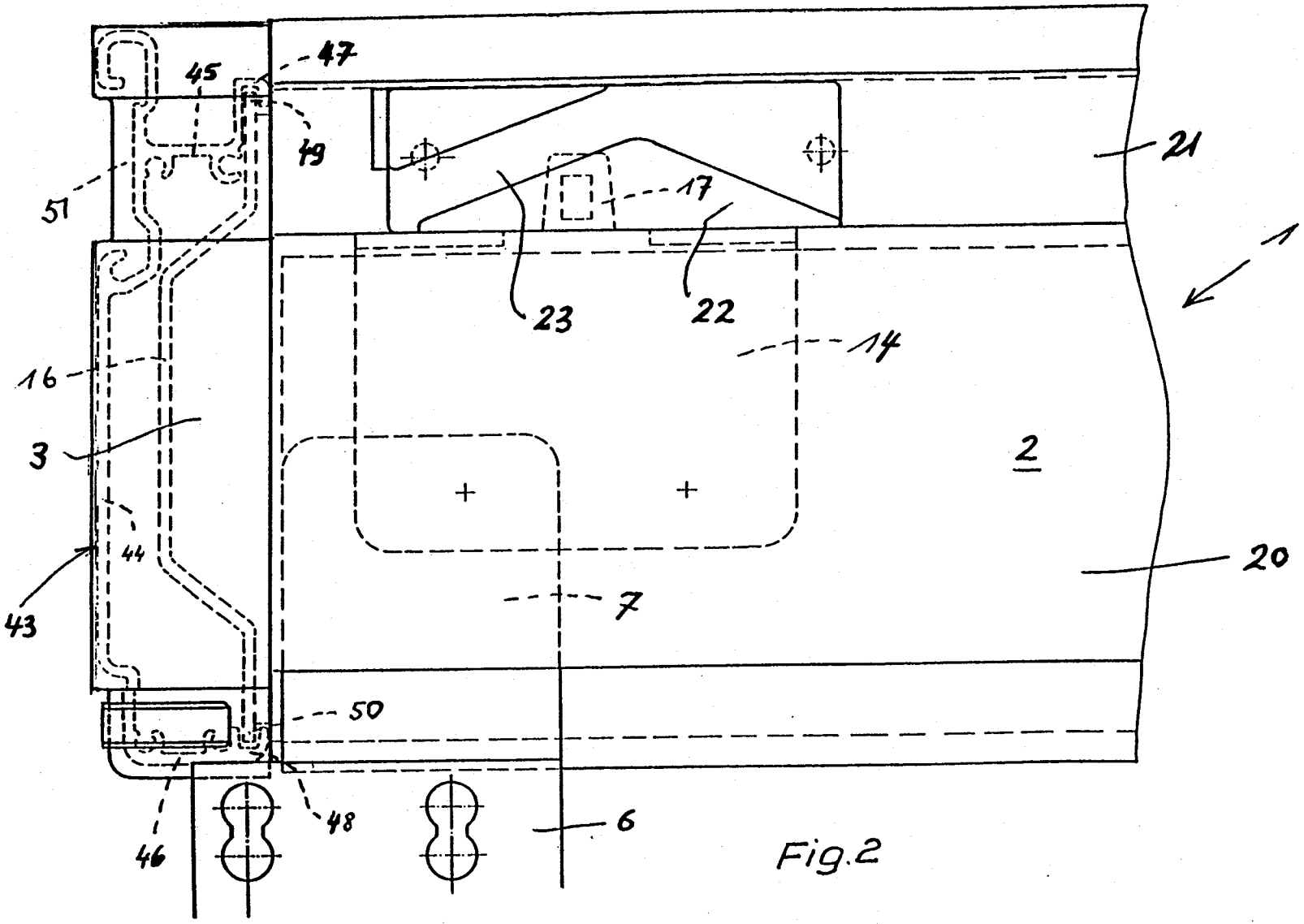
FIG. 2 shows is a partial side view of the drawer taken in the direction of the arrow A in FIG. 1.
Figure 10:
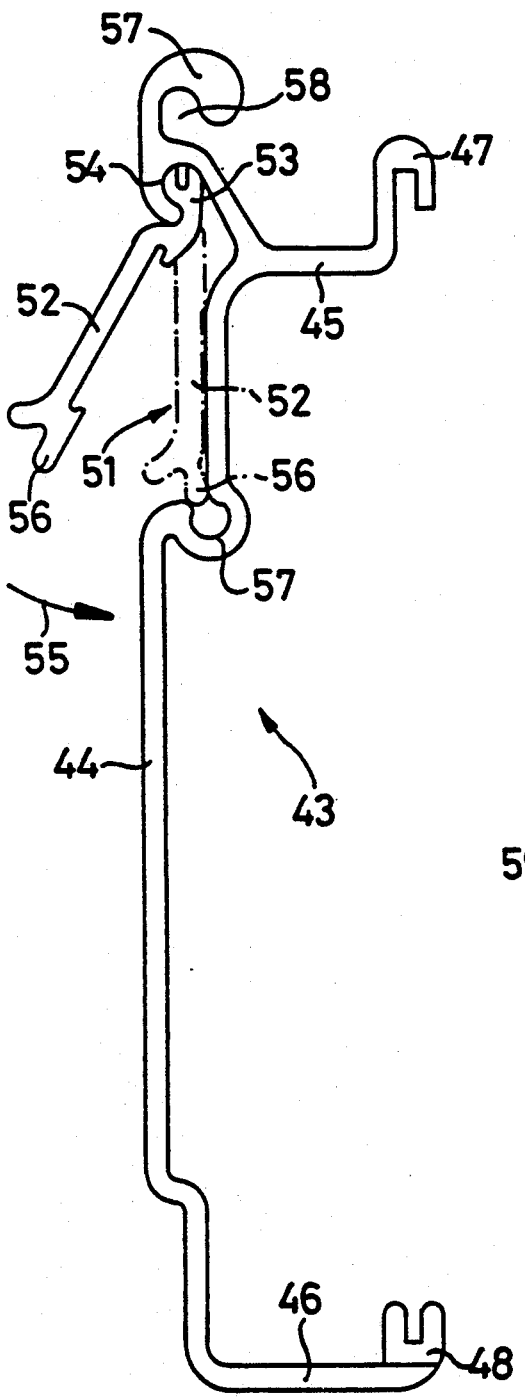
FIG. 10 is sectional view of the drawer panel.

The front crosspiece 16 of the drawer 1, mentioned above, is covered by a front panel 43 made of plastic and shown in an enlarged detail in FIG. 10. Front panel 43 has a front side 44 with an upwardly extending web 45 and a downwardly extending web 46 projecting rearwardly from the front side. Each web 45,46 ends in a rail 47,48 respectively, and the rails are U-shaped in cross section. Front panel 43 can be slid out from the side on the ribs 49, 50, note FIG. 2, along the rails 47 and 48, respectively, with the ribs 49, 50 formed on the front crosspiece 16 of the drawer frame 2. In addition, a compartment 51, is located in the front side 44 of the front panel 43, and serves to display information regarding the contents of the drawer 1. The compartment is covered by a plate 52 formed of a transparent material. Plate 52 has an upper projection 53 engaged in a groove 54 formed in the front side 44 of the front panel 43 with the groove being open downwardly. As shown in FIG. 10, plate 52 is pivoted from its open position in the direction of arrow 55, into its closed position shown in dashed lines with a projection 56 on the lower end of the plate 52 engaging in a lower groove 57 in a spring-like manner. Groove 57 is formed in the front side 44 of the front panel 43 and is open in the upward direction. Moreover, a handle 57, with a handle groove 58, is formed at the upper end of the front side of 44.

Figure 11:
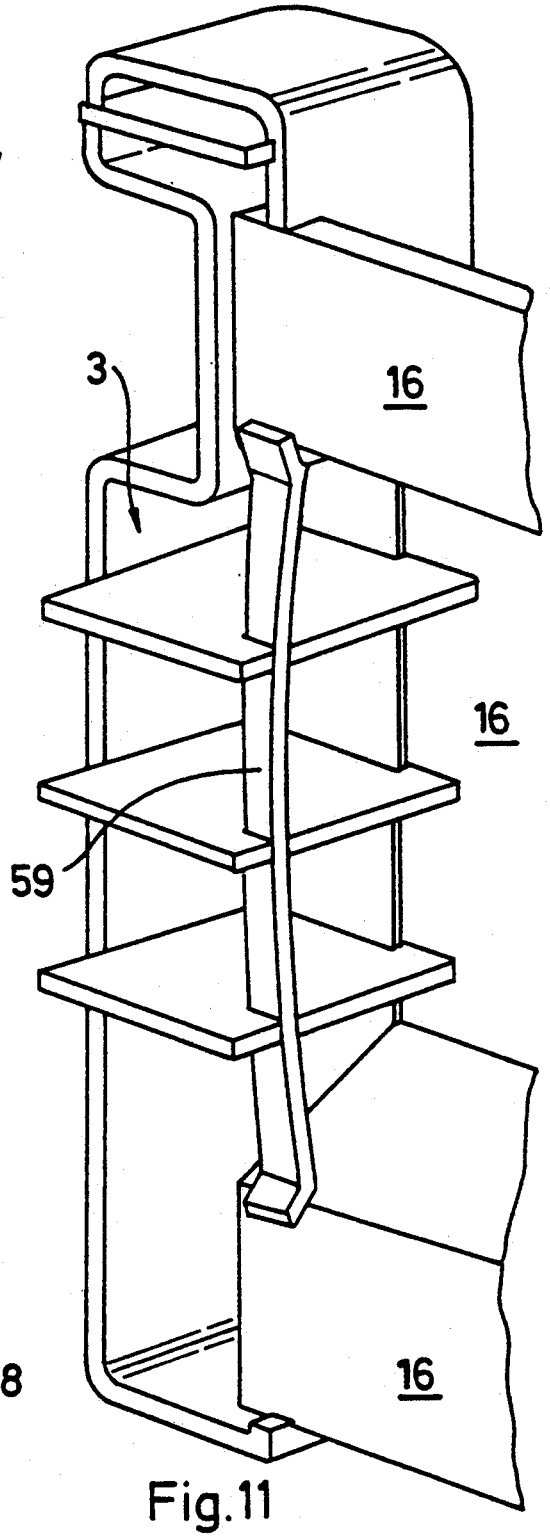
FIG. 11 is a perspective view of the drawer panel corner.

Finally, FIG. 11 exhibits a perspective view of the previously mentioned corner piece 3 which can be placed on the front crosspiece 16 of the drawer frame from the side and is formed from a plastics material and is fixed by a spring clip 59 supported on both sides at the front crosspiece 16.

While specific embodiments of the invention have been shown and described in detail to illustrate the application of the inventive principles, it will be understood that the invention may be embodied otherwise without departing from such principles.

I claim:

1. Support assembly for a drawer, a drawer frame or the like comprising laterally spaced guide rails extending in a first direction, a drawer is detachably mounted on said rails, means for displacing said drawer relative to said guide rails in the first direction, said means comprises two spaced side pieces extending in the first direction, means for selectively supporting said side pieces on said guide rails in at least two different positions spaced apart in the first direction with two different positions spaced a distance apart, said selectively supporting means comprises a part on one of said side pieces and said guide rails engageable in at least two different spaced positions in the other one of said side pieces and guide rails, said part comprises a plug-in member engageable in an opening in the other one of said side pieces and guide rails, said guide rails each comprise a stationery rail and a movable rail displaceable in the first direction relative to said stationery rail, said plug-in connection comprises a first bracket and a second bracket spaced apart in the first direction and secured to said movable rail, said brackets project upwardly from said movable rail, said opening for said first bracket comprises two cut-out portions in said side pieces with said cut-out portions spaced a distance a apart so that said first bracket can be selectively inserted into one of said cut-out portions, and said opening for said second bracket comprises a slot elongated in the first direction and formed in said side piece with said slot having a length a+b, and said bracket has a base with a length equal to b and said slot has ends spaced apart in the first direction and serving alternatively as abutments for a first edge and a second edge facing in the first direction of said second bracket.

2. Support assembly, as set forth in claim 1, wherein said second bracket has an over-all length in the first direction greater than the length of the base of said bracket.

3. Support assembly, as set forth in claim 1, wherein locking means secure said side pieces and said movable rail together for preventing accidental disengagement, said lockable means comprises an opening in said first bracket and a spring clip mounted on at least one of said side pieces and having a catch pawl engagement with said opening in said first bracket.

4. Support assembly, as set forth in claim 3, wherein each said spring clip comprises two said catch pawls spaced apart at a distance a in the first direction and arranged alternately to engage in the opening in said first bracket in dependence on the position of said drawer frame relative to said guide rail.

5. Support assembly, as set forth in claim 4, wherein said spring clip is elongated in the first direction with said catch pawl located between opposite ends of said spring clip and the ends of said spring clip spaced from said pawl transversely of the first direction and disposed in engagement with said side piece.

6. Support assembly, as set forth in claim 1, wherein said movable rail engages telescopically with said stationery rail, said movable rail is located between said side piece and said stationery rail, and said side piece comprising a C-shaped section extending along a part of said side piece.

7. Support assembly, as set forth in claim 6, wherein an apron covers said stationery rail on the opposite side thereof from said movable rail and said apron comprises a C-shaped section transversely of the first direction.

8. Support assembly, as set forth in claim 7, wherein a locking cam is mounted on said apron and is arranged to permit only one said drawer to be pulled out at a time.

9. Support assembly, as set forth in claim 1, wherein said drawer has a front side, a detachable drawer panel removably mounted on the front side of said drawer, and means for securing said drawer panel on the front side of said drawer for easily removing said drawer panel.

10. Support assembly, as set forth in claim 9, wherein said drawer panel forms a compartment for displaying information regarding the contents of said drawer, a removable cover plate formed of a transparent material and covering said compartment.

11. Support assembly, as set forth in claim 10, wherein said cover plate has one side edge engageable in a groove along one side boundary of the compartment and an abutment extending along an opposite side boundary of said compartment from said first groove receives a side edge of said cover plate opposite the side edge engageable in said groove.

12. Support assembly, as set forth in claim 9, wherein a shaped piece forms a drawer corner at each of a pair of opposite sides of said drawer panel, and a spring clip securing said shaped piece to said drawer panel.

13. Support assembly, as set forth in claim 12, wherein rolling means is located in the region of said shaped piece for rolling at the inside of a closet door extending across the front of said drawer when the drawer is pulled out so that the rolling means moves along the inside of the closet door.

* * * * *